United States Patent [19]

Greenberger

[11] 4,177,706

[45] Dec. 11, 1979

[54] DIGITAL REAL TIME MUSIC SYNTHESIZER

[76] Inventor: Alan J. Greenberger, #8 Hart Ave., Hopewell, N.J. 08525

[21] Appl. No.: 922,803

[22] Filed: Jul. 7, 1978

Related U.S. Application Data

[63] Continuation-in-part of Ser. No. 721,447, Sep. 8, 1976, abandoned.

[51] Int. Cl.[2] ..... G10H 1/06; G10H 5/10

[52] U.S. Cl. ..... 84/1.01; 84/1.03; 364/718

[58] Field of Search ..... 84/1.01, 1.03, 1.24, 84/1.26, DIG. 7, DIG. 11; 364/718, 719, 721

[56] References Cited

U.S. PATENT DOCUMENTS

| | | | |
|---|---|---|---|
| 3,515,792 | 6/1970 | Deutsch | 84/1.01 |
| 3,743,755 | 7/1973 | Watson | 84/1.03 |
| 3,763,364 | 10/1973 | Deutsch | 84/1.03 |
| 3,809,786 | 5/1974 | Deutsch | 84/1.03 |
| 3,809,788 | 5/1974 | Deutsch | 84/1.03 |
| 3,809,789 | 5/1974 | Deutsch | 84/1.01 |
| 3,821,714 | 6/1974 | Tomisawa | 84/1.01 |
| 3,831,015 | 8/1974 | Hoff, Jr. | 84/1.01 |
| 3,836,909 | 9/1974 | Cockerell | 84/DIG. 7 |
| 3,878,749 | 4/1975 | Woron | 84/1.01 |
| 3,878,750 | 4/1975 | Kapps | 84/1.03 |
| 3,882,751 | 5/1975 | Tomisawa | 84/1.01 |
| 3,888,153 | 6/1975 | Deutsch | 84/1.03 |
| 3,910,150 | 10/1975 | Deutsch | 84/1.03 |
| 4,052,923 | 10/1977 | Cohn | 84/DIG. 7 |
| 4,077,294 | 3/1978 | Hiyoshi | 84/1.24 |

*Primary Examiner*—B. Dobeck
*Assistant Examiner*—William L. Feeney
*Attorney, Agent, or Firm*—Martin Sachs

[57] ABSTRACT

This disclosure pertains to a digitalized music synthesizer functioning in the real time domain to continuously update, in an asynchronous manner, a continuing approximation of a desired waveform by utilizing its memory of the recent history of the operation of the keyboard of the apparatus. A real time clock and a microcomputer are both driven by a single crystal oscillator, operating at any arbitrary frequency that need not correspond with the frequency of the fundamental or harmonic waves to be produced by the apparatus. A memory of the recent history of keyboard events is maintained. The microcomputer utilizes an algorithm employing square waves as a basis and a differential correcting technique which minimizes the quantity of square wave defining terms that need be computed by only recomputing at each time, corrections to the previous computation. The digitalized output, represented by summing the transient amplitudes comprising the updated approximation to the desired waveform, is fed into a digital to analog converter, an amplifier and a speaker system.

11 Claims, 11 Drawing Figures

DIGITAL REAL TIME MUSIC SYNTHESIZER

BACKGROUND OF THE INVENTION

The present application is a continuation-in-part of parent application Ser. No. 721,447 filed Sept. 8, 1976, now abandoned.

FIELD OF THE INVENTION

This invention relates to music synthesizers and in particular to a synthesizer which employs digital techniques and square waves to approximate desired musical tones which, when modified into analog form, produce a musical tone in accordance with desired characteristics previously stored within a memory bank of a microcomputer.

DESCRIPTION OF THE PRIOR ART

The prior art abounds with musical synthesizers utilizing computers and/or tone generating devices to synthesize complex output waveshapes which are audibly presented to the user of the apparatus.

U.S. Pat. No. 3,515,792 issued on June 2, 1970 to R. Deutsch discloses a digital electronic organ wherein a digital representation of an organ pipe wave shape is stored in a memory. A frequency synthesizer activated by a manual or pedal key produces a clock frequency at Nf, where f is the frequency of the note selected, and N is the number of sample points in the stored wave shape. The digitized wave shape is read out repetitiously at the generated clock frequency and converted to analog form to produce a musical note having a wave shape corresponding to that stored in the memory. Circuitry is provided to sum digitally notes which are played simultaneously; to shape each note in attack and decay using digital operations; and to read out stored multiple wave shapes to implement harmonic and mutation stops.

U.S. Pat. No. 3,809,786 issued on May 7, 1974 to R. Deutsch discloses how musical notes are produced in a computer organ, or like musical instrument, by computing the amplitudes at successive sample points of a complex waveshape and converting these amplitudes to notes as the computations are carried out. A discrete Fourier algorithm using sine waves is implemented to compute each amplitude from a stored set of harmonic coefficients $C_n$, and a selected frequency number R, generally a noninteger establishing the waveshape period. The computations, preferably digital, occur at regular intervals $t_x$ independent of the waveshape period. At each interval $t_x$ the number R is added to the contents of a harmonic interval adder to specify the waveshape sample point qR, where $q=1,2,3 \ldots$ For each point qR, W individual harmonic component values $c_n \sin(\pi/W)nq.R$ are calculated, where $n=1,2,3 \ldots, W$. These values are algebraically summed to obtain the waveshape amplitude, which is supplied to a digital-to-analog converter and a sound system for reproduction of the generated musical note.

Attack, decay and other note amplitude modulation effects are obtained by programmatically scaling the harmonic coefficients. Foundation and mutation stops are implemented by appropriate selection of the stored harmonic coefficient values. Multiple voices are produced by adding the harmonic coefficients associated with each selected stop. In a polyphonic system, time sharing and multiplexing may be used to calculate separately the sample point amplitudes for each selected note, these amplitudes being combined to reproduce the resultant musical sound.

U.S. Pat. No. 3,888,153 issued on June 10, 1975 to R. Deutsch discloses the production of musical notes containing anharmonic overtones as implemented by a computer organ such as disclosed in U.S. Pat. No. 3,809,786 to the same inventor. In such an instrument, the sample amplitudes of a musical waveshape are computed in real time by individually calculating the amplitude contributions of the Fourier sine wave components constituting the waveshape. In accordance with the present invention, certain of these Fourier components are evaluated at frequencies offset from multiples of the nominal fundamental frequency of the note being generated. This is accomplished by utilizing in the overtone amplitude calculations offset values $n_\nu$ which establish the extent of anharmonicity of each overtone. This results in complete freedom of control of the anharmonicity of individual overtones. The overtone offset ($n_\nu$) values may be stored in a memory, or may be generated by appropriate circuitry.

In certain embodiments the offset is proportional to the frequency of the note being produced, preferably being a constant number of cents. Other embodiments include, among other things, constant frequency offset independent of time, time variant anharmonicity, offset of alternate overtones in opposite frequency directions, and overtone selection to insure correct frequency of a subjective fundamental.

U.S. Pat. No. 3,809,789 issued on May 7, 1974 to R. Deutsch discloses harmonic limiting as employed in an electronic musical instrument of the type wherein notes are produced by computing the amplitudes at successive sample points of a musical waveshape and converting these amplitudes to notes as the computations are carried out in real time. Each amplitude is computed by accumulating as many as W individually calculated waveshape discrete Fourier sine wave components. In accordance with this invention, harmonic inhibit means are provided for limiting the Fourier components included in each amplitude computation only to those having frequencies below a certain value preferably within the normal human hearing range.

U.S. Pat. No. 3,743,755 issued on July 3, 1973 to G. A. Watson discloses an apparatus having a memory bank, containing digital data of related informational contents in a plurality of discrete locations identified by respective addresses. The memory is addressed, or accessed, at a rate which depends upon the desired spacing between data from the various locations as it is sequentially read from the memory. In a specific embodiment, the data constitutes amplitude values of a complex waveform of the type produced by a musical instrument, at equally spaced points in time along an axis of the waveform. Apparatus for addressing the memory at any of a plurality of selectively controlled rates includes a calculator for continuously computing a set of numbers, each defining a different spacing between the data during readout of the memory. When a desired frequency of repetition of a complete cycle of the stored waveform is to be determined, the number associated with that rate is sampled from the computed set and is periodically increased by its own value to identify appropriate data addresses in the memory, for accessing that data, at intervals of the periodic increase corresponding to the desired rate of readout.

U.S. Pat. No. 3,821,714 issued on June 28, 1974 to N. Tomisawa et al, pertains to an apparatus utilizing a plurality of memories for storing, either digitally or in analog form, a sampling of a variety of fundamental and harmonic waveforms. In the case of digital storage, specific digital signals are combined with digitalized control signals and are eventually converted to analog signals.

The prior art relies heavily, inter alia, upon digital machinery employing hardwired "programs". A large number of components and interconnections are required to create such a program depending upon the level of realism of the sounds they are designed to produce. In general, the more sophisticated the sound, the more complex the circuitry. Cost and power dissipation increases in accordance with complexity of the produced sound. The algorithms used, such as in the Deutsch U.S. Pat. No. 3,809,786, have been complex, requiring substantial time periods to complete the computations necessitating lengthy and regular time intervals therefor.

Since the architecture of the computers utilized heretofore were prestructured in accordance with the tone-color characteristics of the musical tone waveshapes to be obtained, flexibility in the use of the apparatus was minimized. A specific algorithm, having a given complexity is required to synthesize specific tonal characteristics of the desired music, thereby limiting the flexibility of the apparatus to the pre-programmed algorithm selected. Since much of the prior art converts digital data stored in a memory bank, utilized in combination with a discrete Fourier algorithm to compute the amplitudes of musical notes as the computations are carried out, a substantial period of time is consumed to effectively carry out the computations to the degree required to produce a high quality musical tone each time such a tone is called for, for example, by the depression of an individual note key in a musical keyboard. The more complicated the algorithm, the more difficult the choice between extended computational time periods and reduced tonal quality, with the only cures against a sacrifice between either extreme residing in increasing the cost and complexity of the computational equipment, such as by increasing the components therein, or requiring computers whose operational speed exceeds the limit available in the present state of the art.

Many of the prior art disclosures utilize sine and cosine computational terms, requiring multiplication of the transient amplitudes contained therein when in sine and cosine waveshape form. Extra multiplication hardware is required as well as sine and cosine look-up in order to effect a reconstruction of the amplitude, by computing and summing all the terms during each computational period. This approach being essentially an integrating technique, requires considerable computation time unless the apparatus discards a portion of the sampling points utilized to adequately describe the entire period of a waveform, such as described in U.S. Pat. No. 3,763,364 issued on Oct. 2, 1973 to R. Deutsch et al.

SUMMARY OF THE INVENTION

A primary object of the present invention is to provide a closed loop computing system which continuously updates a digital memory holding the recent history of all keyboard events, thus minimizing the need to separately synthesize a musical tone on each occasion that tone production is called for by the apparatus user.

Another object of the present invention is to provide a music synthesizer whose computational period is minimized due to a synthesizing process which utilizes square waves rather than sine and cosine waveforms.

Still another object of the present invention is to provide an apparatus utilizing a single crystal oscillator whose material frequency is not necessarily related to the frequency of the fundamental or overtones handled by the computer portion of the apparatus, thereby eliminating the need for tuning or multiple oscillators.

Yet another object of the present invention is to provide an apparatus capable of performing its function by the use of memory control of a microcomputer rather than hardwired complex program circuitry.

A further object of the present invention is to provide an apparatus utilizing a computational algorithm employing a differential technique whereby only the changes as a function of time need be computed rather than whole waveforms at all times.

A still further object of the present invention is to provide an apparatus utilizing a microcomputer which is capable of performing a computation approximating a complex waveform as a function of time, asynchronously, with the resultant approximation occuring within a pseudo-random time grid pattern.

The present invention takes full advantage of the fact that digital equipment can be utilized to the greatest advantage when handling information in square waveform as opposed to periodic Fourier algorithmic creation of sinusoids. Since square wave functions can always be defined in terms of a value of plus or minus one within a given time period, summation or subtraction of the square wave components thereof comprise the natural and most simple technique for use with a computing apparatus handling data in digital form.

Furthermore, the current availability of microcomputers, utilizing integrated inexpensive circuits therein, enhances the commercial feasibility of such apparatus. The present invention, because of the closed loop computational scheme employed, requires only minimal time periods and minimal quantities of electronic circuits to "correct" the computations from a previously computed desired waveform. This approach further decreases the cost and complexity of the machinery heretofore employed in the synthesis of musical tones, which utilizes the real time domain for such synthesis. Though the envelope waveforms are stored within the digital memory of the apparatus disclosed herein, and though an expansion of such stored information in terms of square waveforms contain about twice as many terms as the terms required to emulate musical tones based on sine or cosine waveforms, multiplication, as a required step when utilizing sinusoidal waveforms, is eliminated. The computation technique of the present invention may be performed by the simple process of adding or subtracting transient amplitudes. Another advantage resides in the fact that differential comparison corrective techniques can be employed, eliminating to a great extent the recomputation required for the lower frequency terms comprising the composite synthesized waveform.

A musical synthesizer wherein musical waveshapes are synthesized, according to the principles of the present invention, comprises memory means for storing a set of transient envelope waveshapes and a set of harmonic frequencies constituting the musical waveshapes, means coupled to the memory means for comparing and digitally approximating the musical waveshapes by the summing of square wave signals into digitalized waveform approximations of musical waveshapes, and selecting means coupled to the memory means, a plurality of each selecting means controlling the initiation of one of the musical waveshapes, means coupled to the selecting means and the memory means for non-periodically computing the musical waveshapes dependent upon the state of any of the selecting means, the computing means including signal information derived from the state of the selecting means.

These objects, as well as other objects and advantages of the present invention, will become more readily apparent after reading the following description of the accompanying drawings.

DESCRIPTION OF THE PREFERRED EMBODIMENT

Figure 1:
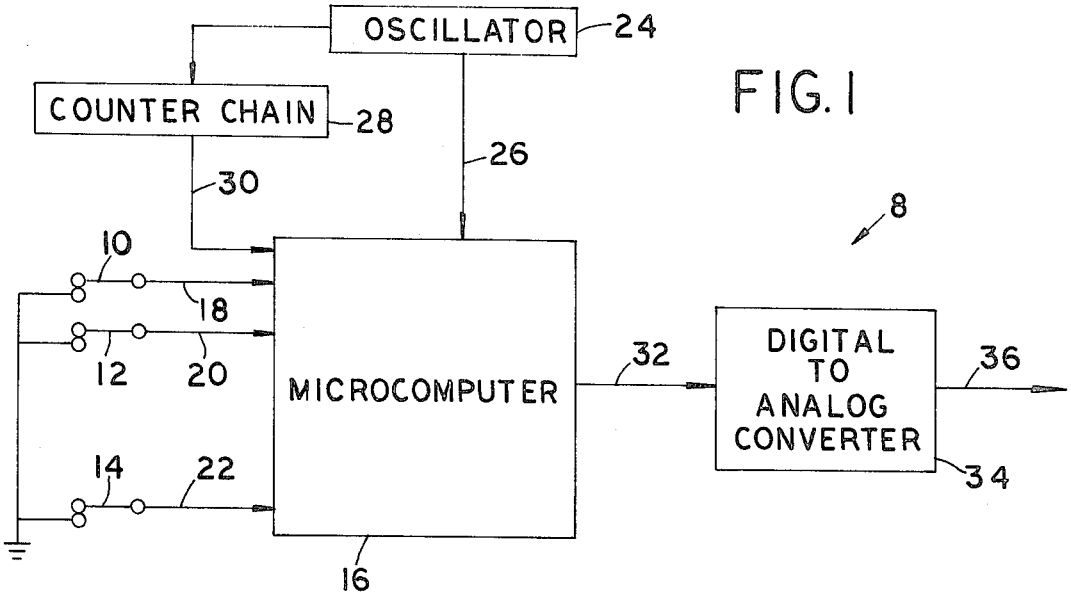
FIG. 1 is a functional block diagram of a synthesized musical instrument in accordance with the present invention.

The structure and method of fabrication of the present invention is applicable to a digital electronic real time music synthesizer. A real time clock and a microcomputer are both driven by a simple oscillator, preferably of the crystal variety. The microcomputer reads the state of a manually operated keyboard and the time from the real time clock in an asynchronous manner, and utilizes an algorithm employing square waves to compute a continuing approximation to the appropriate waveform in a differential approximating technique. The oscillator of the preferred embodiment has two functions. One function is to operate as a standard clock and driver for the microcomputer. The other function thereof is to drive a counter chain comprising a plurality of numerical dividing stages. The counter chain, serving as a real time clock is interfaced with the microcomputer so as to allow the microcomputer to read the time. The oscillator frequency is selected at some arbitrary stable value, sufficiently high to drive the microcomputer at its required rate. All the timing will be performed by having the microcomputer compare the time that it reads with times stored in its memory, thereby permitting the choice of the oscillator frequency to be of any convenient value that need not be a harmonic of any required tone.

The microcomputer employed herein samples the current time from the real time clock whenever the computation from a previous approximation is completed. Thus, in the present invention, the microcomputer program timing of tonal approximations is asynchronous because the computational time varies from computation to computation depending upon the recent history of the use of the manually operated keys.

The output waveform is generated utilizing digital computational techniques. The computer generated waveform is coupled to a digital to analog converter and then to a conventional amplifier and speaker system to produce the necessary acoustics without requiring filters or other waveshaping or modifying apparatus. Since the present invention utilizes square waves as its computational basis, it requires more terms, perhaps twice as many, in a harmonic expansion of a function than that required by an expansion expressed in terms of a Fourier analysis of sines and cosines.

However, the actual number of extra terms required when utilizing square wave functions is highly dependent on the waveshape to be synthesized and the degree of precision required.

The present invention may be utilized in the production of musical tones emulating a wide variety of musical instruments, or in implementing new instruments. By way of example only, a Harpsichord emulator is described herein, utilizing the principles of the present invention. It should be understood that this specific embodiment, though illustrating the application of the present invention to a specific form of apparatus, should not be construed so as to limit the general applicability of the invention.

A keyboard, comprising either switches or any other transducers, such as an analog transducer, which, for example, can sense the pressure, velocity, or acceleration with which a key is pressed, is used to initiate an output tone from the acoustics generating apparatus. The analog or non contact engaging type transducers may further provide data, which when converted into digital form can control the manner of emulation of the output signals of the apparatus. These signals may simulate the dynamic keyboard instruments, such as pianos and the like. Since the Harpsichord is not a dynamic instrument, the Harpsichord emulator disclosed herein, utilizes a plurality of on-off or contact engaging type switches in the keyboard.

Let k be a subscript, referring to the different keys on a Harpsichord which may initiate a tone. If the set of keys k have been operated at a most recent time $t_k$, let an approximation to the sum of the transients be:

$$f(t) = \sum_{\{k\}} \left[ \sum_{\{n_k\}} (A_{nk}(t - t_k)\, SQR\,(w_{nk}\, t) + B_{nk}(t - t_k)\, CSQ\,(w_{nk}\, t)) \right];$$

where $n_k$ is a set of labels for square wave harmonics that are needed to approximate key k and $A_{nk}$ (t) and $B_{nk}$ (t) are the transient envelopes for a given key harmonic. SQR(wt) and CSQ(wt) are square wave functions which the present invention utilizes as its synthesis basis permitting simple addition and subtraction of harmonic components of the desired output waveform. The $A_{nk}$ (t) term may be stored within the microcomputer memory and be looked up as required or computed, if so desired. Since the human ear is insensitive to harmonic phase relationships, utilizing Ohm's approximation, the generalized approximation of f(t) may be simplified yielding;

$$f(t) = \sum_{\{k\}} \left[ \sum_{\{nk\}} (A_{nk}(t - t_k)\, SQR\,(w_{nk}\, t)) \right].$$

Different keys of the keyboard may have some harmonic frequencies in common, which may be expressed as;

$$w_{n1k1} = w_{n2k2}.$$

This is especially true for those instruments, such as a Harpsichord, which may be approximated as an instrument rich in harmonics from key to key. Utilizing this fact, it is more efficient to reverse the order of summation and writing the approximation as follows;

$$f(t) = \sum_{\{n\}} \left[ SQR(w_n t) \left( \sum_{\{k\}} A_{nk}(t - t_k) \right) \right]$$

Thus the number of terms and computational steps relating thereto are limited in number, with the calculation of f(t) performed by the simple additions and subtractions, in square waveform to arrive at the digitalized version of the desired tone.

The microcomputer, reads the current time, $t_i$, from the real time clock and also examines the state of the keyboard. If a new key has been depressed, then the microcomputer, for only k, which was a new key request, sets $t_k = t_i$. The microcomputer then continues its computation. A memory register, within the microcomputer, has stored the last value of the function $f(t_{i-1})$. The microcomputer begins a search through its harmonic list {n} to test if any harmonics have gone through another half period since the last time, denoted by $t_{i-1}$. If such a harmonic has gone through a half period, the program then computes $$\sum_{\{k\}} A_{nk}(t - t_k)$$

for that harmonic if that harmonic possesses a non-zero transient value and adds or subtracts it from the previous sum. When the microcomputer has completed testing for all harmonics that have gone through another half period, the computation is complete and includes all changes to the previous approximation necessary to produce the current approximation at time $t_i$ without having to compute any non-relevant terms. Essentially, the computation of the current approximation is by way of updating the previous approximation at time $f(t_{i-1})$. When the latest appoximation is completed, by way of summation, the output of the microcomputer latches up to the input to the digital to analog converter. The program then loops back and repeats the above-described procedure. The preferred embodiment of the present invention utilizes a closed loop keyboard searching criterion to test for the initiation of new terms together with a differential correction procedure which tests whether it is time yet to make any changes in the sum from the previous time, and makes only those changes rather than totally re-computing the sum at each time.

Now referring to the figures, and more particularly to the preferred embodiment of a music synthesizer 8 illustrated in FIG. 1 showing switches 10, 12, and 14, forming part of a keyboard 9 having K keys. The manual operation of any key within the keyboard is signalled to microcomputer 16, by way of wires 18, 20 and 22. An oscillator 24, couples a timing output signal to microcomputer 16 via wire 26, and may be of the crystal variety. Oscillator 24 also drives counter chain 28, via wire 30, to the microcomputer. The counter chain output signal has a period substantially greater than the period of the output signal generated by oscillator 24 and is in direct proportion to the number of dividing stages therein. The output digitalized synthesized signal generated within microcomputer 16, is coupled to a digital to analog converter 34, via a wire 32. A synthesized analog waveform is coupled via a wire 36, and utilized by a sound reproducing system which includes a conventional amplifier 37 and a speaker system 39 coupled thereto via a wire 41.

Figure 2:
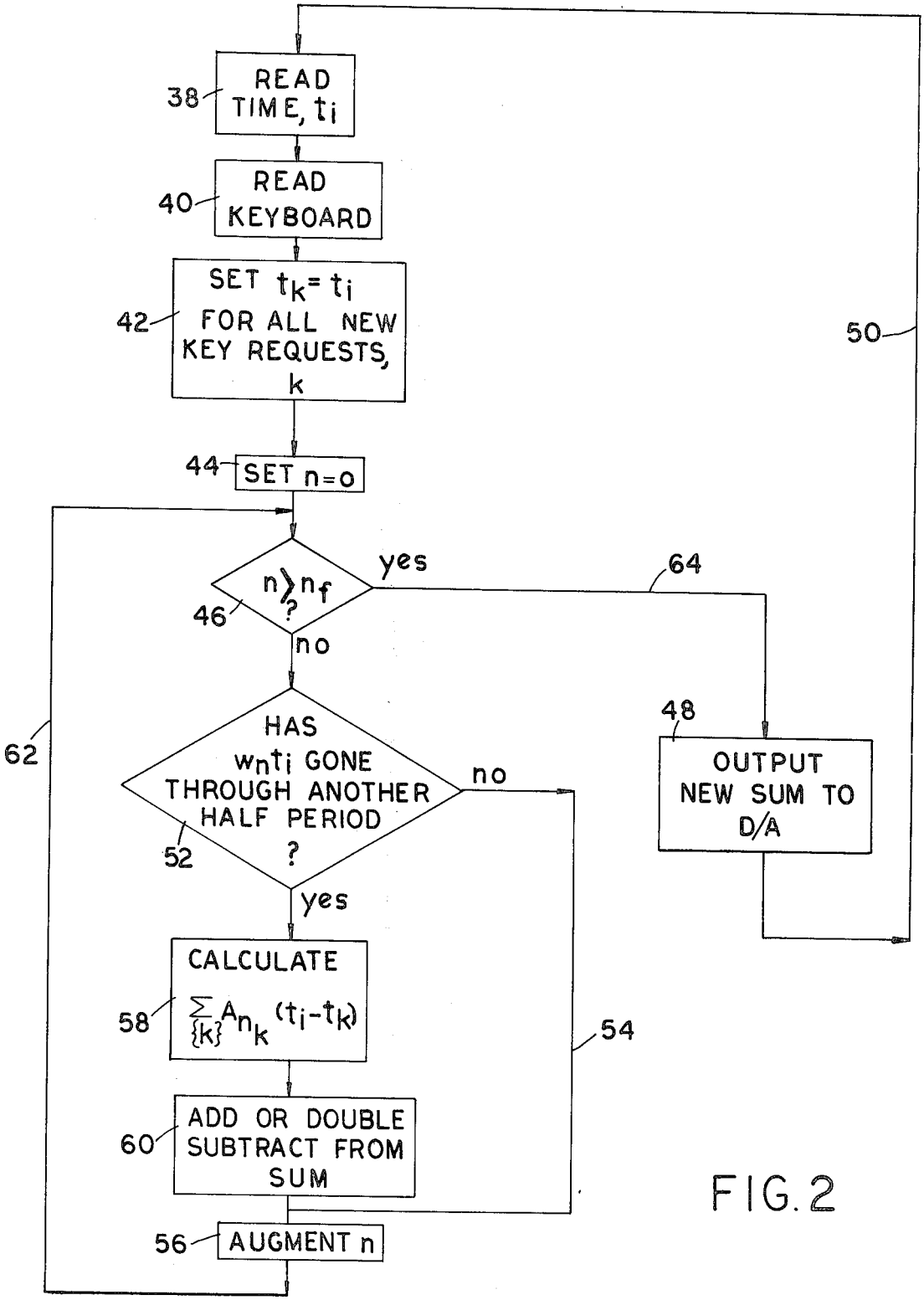
FIG. 2 is a logical flow chart of the note generation algorithm of the present invention, when employed as a Harpsichord emulator.

FIG. 2 illustrates the logical flow chart utilized in the microcomputer 16, shown in FIG. 1, in a form suitable to operate the apparatus therein as a Harpsichord emulator. Block 38 reads the time $t_i$ as fed to the microcomputer 16 by way of wire 30, as shown in FIG. 1. Block 40 reads the keyboard by way of representative wires 18, 20, and 22 as shown in FIG. 1. If there are any new keys that have been depressed, the apparatus sets $t_k = t_i$, the current time, for those new values of k. Blocks 38, 40, and 42 contained within microcomputer 16 together with the keyboard effectively forms a closed loop which maintains the recent history of the state of the keyboard always up to date. Block 44 sets n to zero wherein n represents a set of labels for the square wave-shaped harmonics that are required to approximate the tone to be synthesized upon the operation of a specific key within the k key set. Block 46 determines whether or not the harmonic label n is greater than harmonic label $n_f$, the final harmonic in the set. If the answer is yes, block 48 is utilized to provide an output to a conventional digital to analog converter, 49 which in turn is coupled to a conventional amplifier 51 and speaker 53; and to couple, via wire 50, digital feedback information to block 38, which is awaiting the next keyboard status change.

Block 52 decides whether or not the product of the angular frequency $w_n$ and the time has gone through another half perod of the square function $SQR(w_n t)$. If such is not the case, this information is coupled via pathway 54 to block 56. Alternatively, if $w_n t$ has gone through another half period block 58 will calculate or look up the transient amplitudes $A_{nk}$. Such calculated information which is in square wave format is added or if entering the second half period, subtracted, from the sum in block 60. Note that this addition or subtraction occurs only once during each square harmonic period corresponding to each $SQR(w_n t)$ as opposed to calculating sines over and over at many times within a period. A major contribution of the present invention is its speed and simplicity of computation accomplished in the apparatus described in blocks 58 and 60. The synthesized and augmented harmonic components are accumulated in a partial sum while the apparatus augments its index n of harmonics. As long as there are still harmonics not yet dealt with, the present invention accumulates corrections to the sum. Once the complete list of harmonics has been dealt with, the index n exceeds the final value $n_f$ and the signal branches to block 48. Block 48 is utilized to provide an output to a conventional digital to analog converter 49, once the latest computation is finished. The signal then loops back via pathway 50 and begins again.

Figure 3:
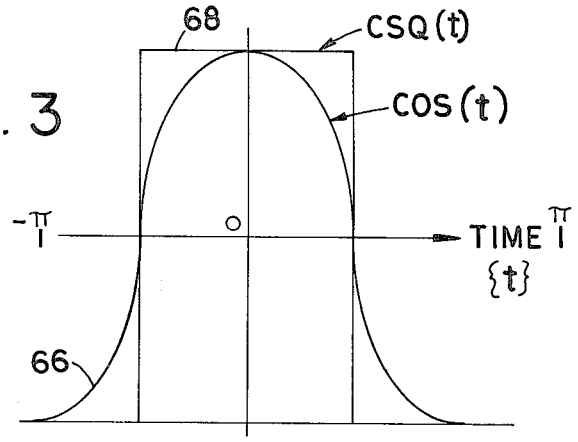
FIG. 3 illustrates a cosine waveform and its square wave counterpart.

FIG. 3 illustrates one cycle of a cosine waveform 66 denoted as cos(t). Square waveform 68 denoted as CSQ(t) has the same periodicity and the same amplitude as waveform 66. A harmonic set of either function forms a valid linearly independent basis for harmonic analysis. Waveform 66 may be adequately simulated by the summing of square waves in harmonic terms, to approximate waveform 68.

Figure 4:
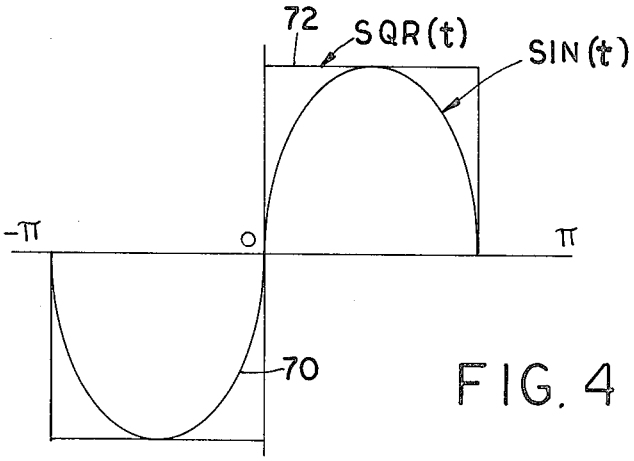
FIG. 4 illustrates a sine waveform and its square wave counterpart.

FIG. 4 illustrates the sinusoidal waveform 70 denoted as sin(t) and its equivalent square wave counterpart 72 denoted SQR(t).

A microcomputer and memory such as the family of components manufactured by Motorola Semiconductor Products Inc., Model No. 10800, in conjunction with a conventional crystal oscillator and a conventional counter chain, and a conventional digital to analog converter, may be utilized to demonstrate the features of the invention disclosed herein.

The following alternative commercial components may be utilized to accomplish the functions described in the functional block diagrams shown in the figures as part of the microcomputer.

TABLE I.

| Function | Manufacturer | Model |
|---|---|---|
| Register | Advanced Micro Devices (AMD) | 74S377 |
| Logic Array | Signetics Corporation | 82S100 |
| Micro-program Controller | AMD | 2910 |
| Control Memory | Signetics Corporation | 82S191 |
| Tristate Bus Driver | AMD | 74S240 |
| Data Bus Source Decoder | Signetics Corporation | 74S138 |
| Asynchronous Shifting Logic | Signetics Corporation | 8243 |
| 4 Bit Slice | AMD | 2901 |
| Look Ahead Carry Generator | AMD | 2902 |
| Scratchpad Memory | Signetics Corporation | 82S208 |

Figure 5:
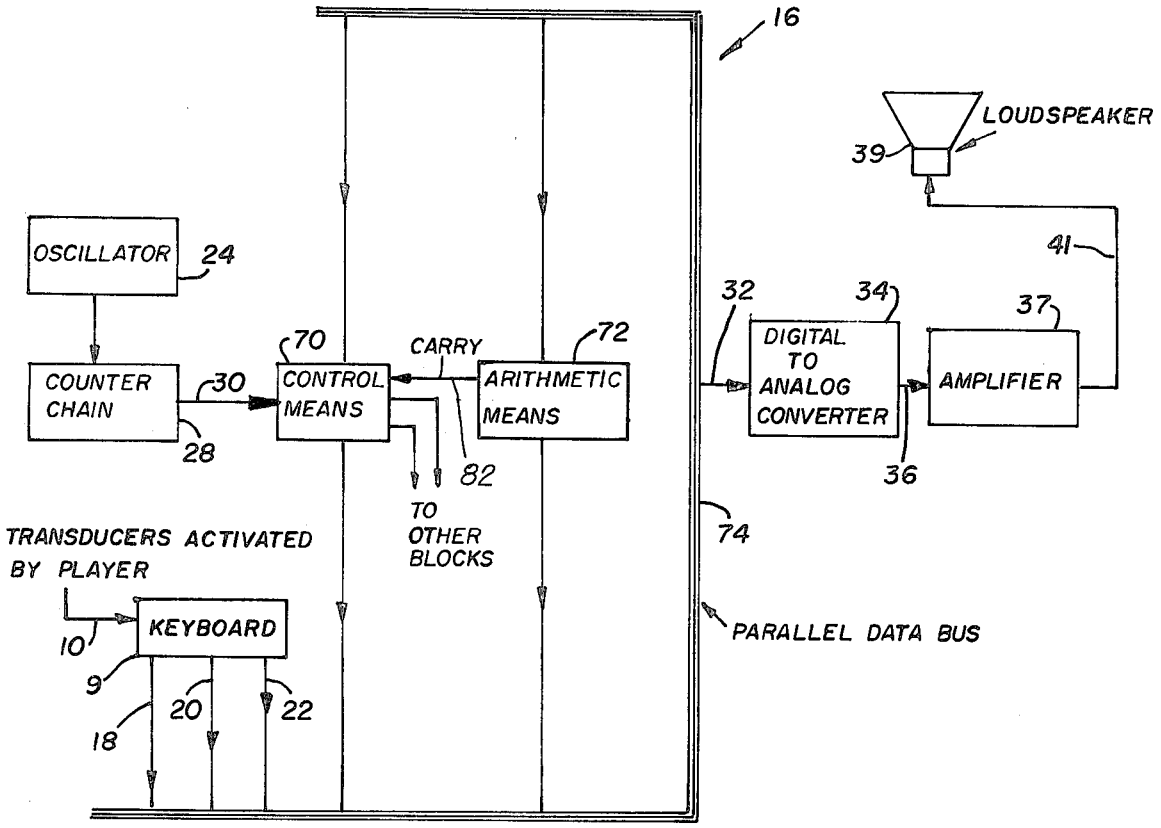
FIG. 5 is a block diagram of a portion of a microcomputer, according to the principles of the present invention.

The functioning of the microcomputer and memory 16 is shown in more detail in FIGS. 5 through 11. FIG. 5 shows the microcomputer 16 with control means 70 and arithmetic means 72 which operate simultaneously and utilize as well as supply digital information appearing on the data bus 74. The information on data bus 74 permits the bidirectional transfer of digital data between all of the sub-sections of the microcomputer 16 or individual blocks (components) as listed herinbefore.

Figure 6:
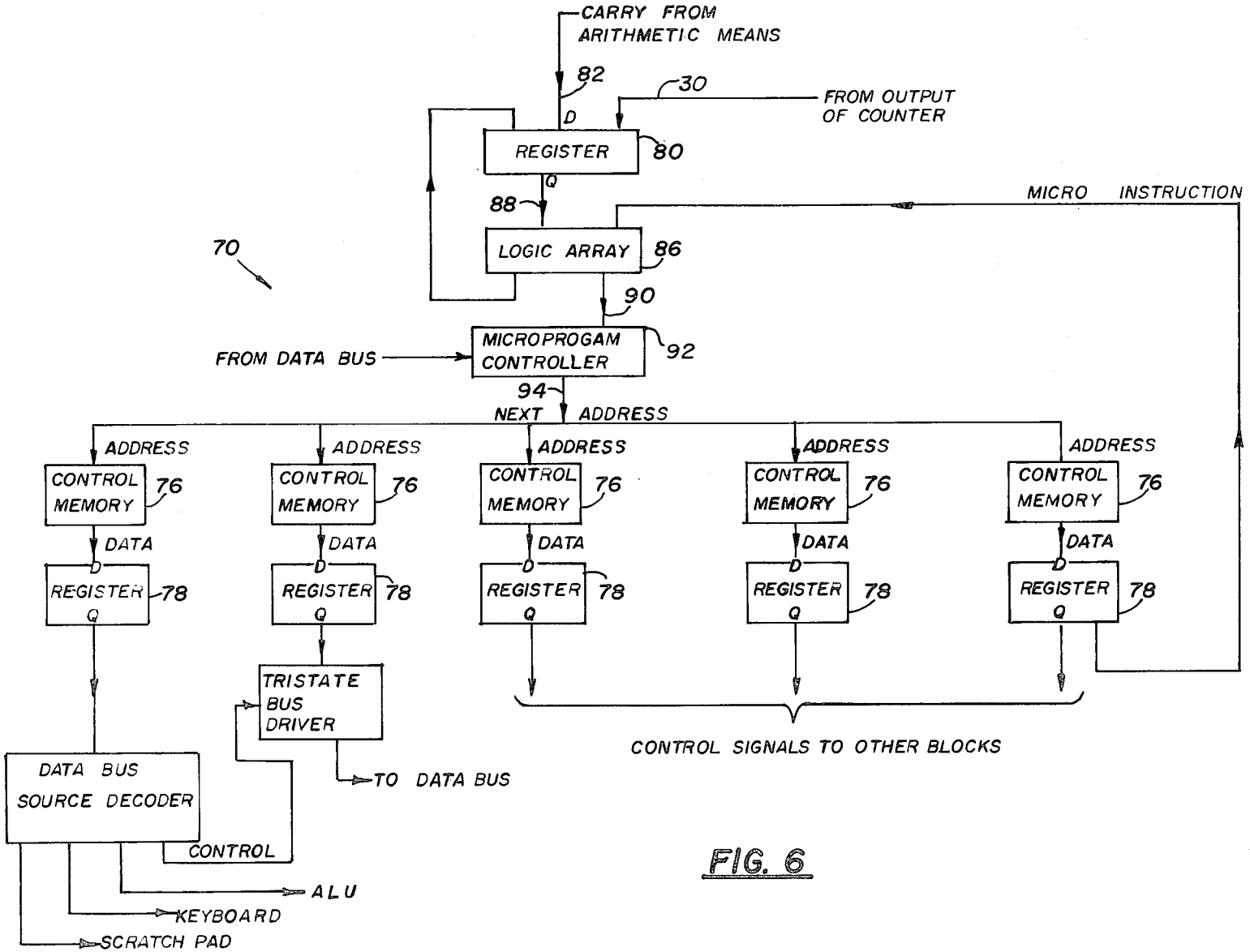
FIG. 6 is a block diagram of the microcomputer control means in greater detail.

FIG. 6 shows in greater detail an embodiment of the control means which, here again, may be fabricated from separate independent logic chips as set forth hereinbefore.

A microprogram is stored in the control memory portion 76 of the control means 70. A plurality of control memory portions 76 are utilized, each identical. A plurality of registers 78 hold the current microword. Several bits of this microword function as a microinstruction. An additional register 80 is used as a logic storage as well as for receiving the carry information, via line 82 from the arithmetic means 72 and the divided counter signal, via line 30, from the counter chain 28. A logic array 86 is coupled to the register 80, via a line 88, and converts the current micro-instruction and status into appropriate control signals which are coupled, via a line 90, to a microprogram controller 92. The microprogram controller 92 generates the next micro-instruction address, which is repeated once each clock cycle, and feeds it to the proper control memory units 76, via a line 94.

Figure 7:
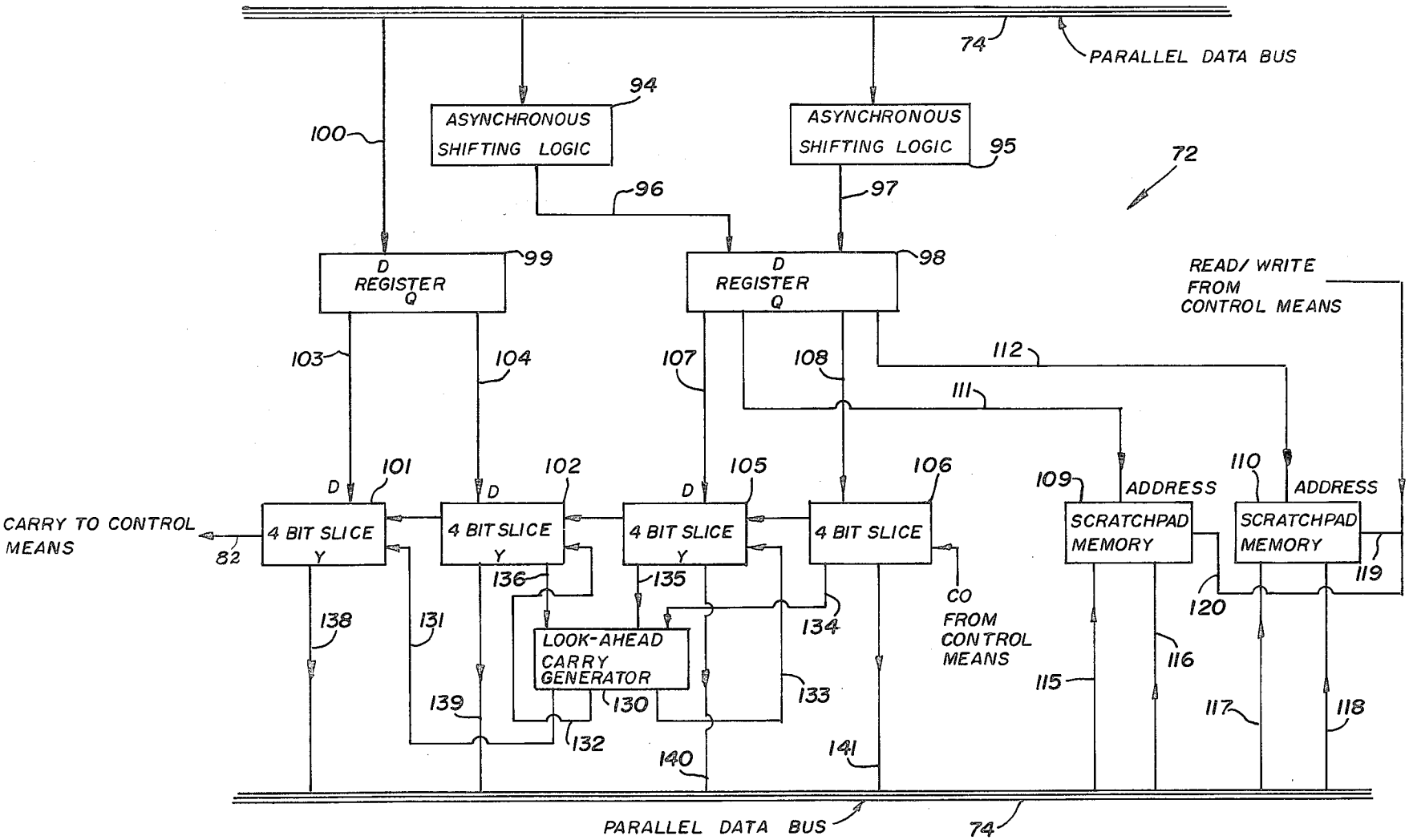
FIG. 7 is a block diagram of the microcomputer arithmetic means in greater detail.

FIG. 7 discloses in greater detail one embodiment of the arithmetic means 72 which utilizes asynchronous shifting logic 94 and 95 for the rapid binary scaling of data, having their outputs coupled via lines 96 and 97, respectively into a register 98. Register 99 receives its input from data bus 74, via a line 100. The outputs of register 99 are coupled to a 4 bit slice 101 and 102, respectively, via lines 103 and 104, respectively. The outputs of register 98 are coupled to 4 bit slices 105 and 106, via lines 107 and 108, respectively. The outputs of register 98 are also coupled to scratchpad memories 109 and 110, via lines 111 and 112, respectively. The scratchpad memories 109 and 110 feed their output signals and receive input signals to and from the data bus 74, via lines 115, 116, 117, and 118, respectively. Memories 109 and 110 also receive an input signal, via lines 119 and 120 from the control means 70. The scratchpad memories are conventionally known as read/write or random access memories.

Each 4 bit slice 101, 102, 105, and 106 contains an arithmetic logic unit which is capable of addition and subtraction, in addition to, logic operation. Each 4 bit slice also contains registers which hold the time, total, partial sums and function as temporary storage as needed. A look ahead carry generator 130 is used in conjunction with the 4 bit slices 101, 102, 105, and 106 to allow for faster addition and is coupled thereto via lines 131, 132, 133, 134, 135, and 136. The output from the 4 bit slices are coupled to the data bus 74 via lines 138, 139, 140 and 141. It is to be noted that the present invention does not utilize any hardware to perform multiplication functions but instead uses only addition and subtraction.

Figure 8:
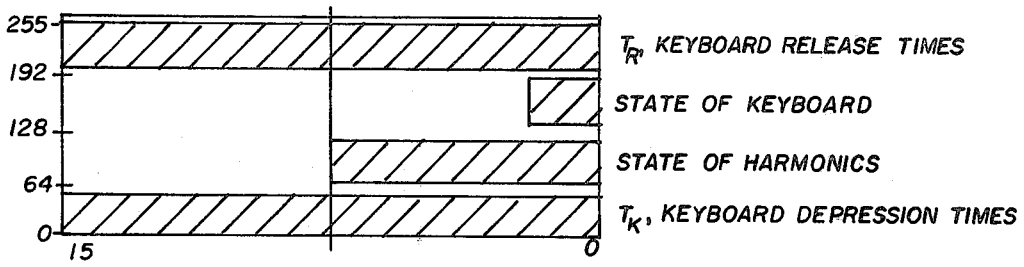
FIG. 8 graphically represents the information stored in the scratchpad memory portion of the microcomputer utilized in the present invention.

FIG. 8 graphically represents the contents of the scratchpad memories 109 and 110. For each key 10, 12, 14, etc., the scratchpad memory 109 and 110 retains the time it was last depressed ($t_k$), the time that it was last released ($t_r$), the current state of each key (i.e., off, sounding or closed, decaying after release), and the current state of each of the square wave harmonics used as a reference.

Figure 9:
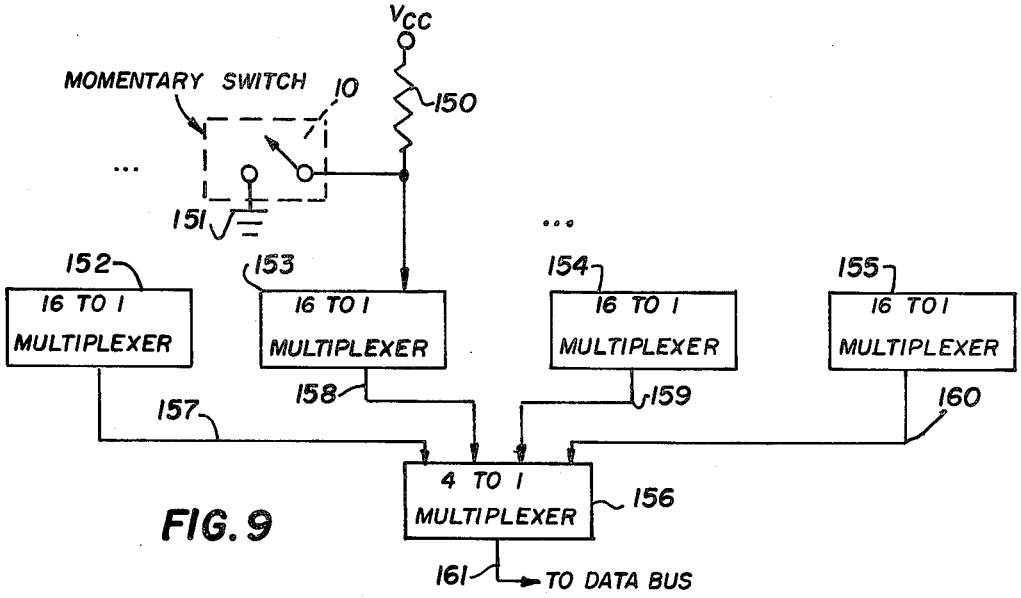
FIG. 9 is a block diagram of a contact activated keyboard and its associated multiplexer portions of the microcomputer.

FIG. 9 discloses one embodiment of a contact actuated keyboard which may include a key switch 10 coupled to a source of D.C. potential, Vcc via a resistor 150. Closing mementary switch 10 completes the circuit path to ground 151, thereby providing a change of state to the 16 to 1 multiplexer 153. In a like manner, switches not shown are connected to multiplexers 152, 153, 154 and 155. The output of multiplexers 152, 153, 154, and 155 are coupled to a 4 to 1 multiplexer 156, via lines 157, 158, 159, and 160 respectively. The output of multiplexer 156 is coupled to the data bus 74 via a line 161. Each switch is connected to one input of one of the multiplexers 152, 153, 154, and 155. Control signals, not shown, control which of the keys are logically connected to the data bus 74.

Figure 10:
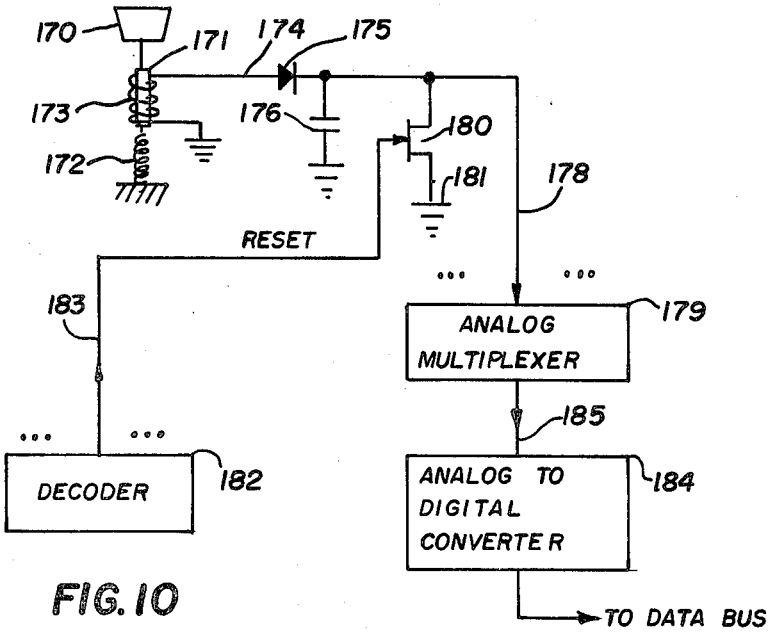
FIG. 10 shows one embodiment of an analog switch, which may be utilized with the present invention.
Figure 1:
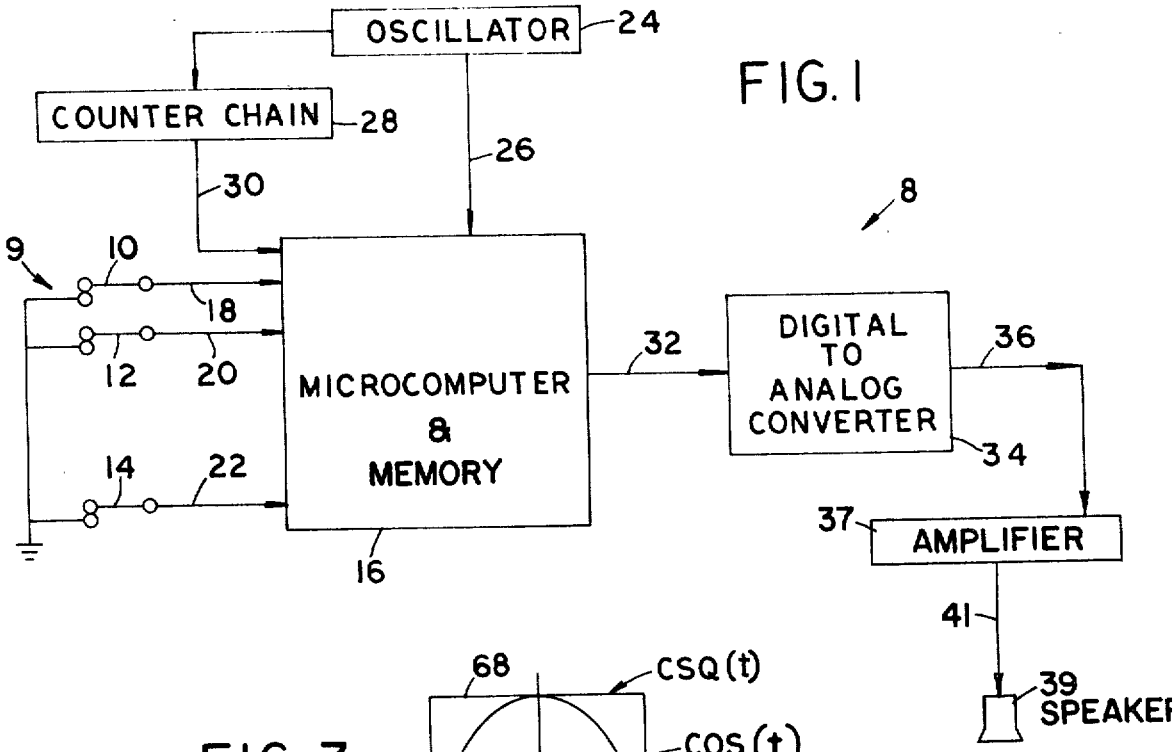
Figure 3:
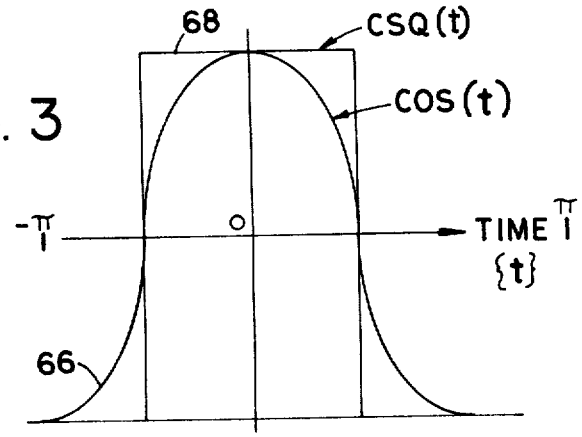
Figure 4:
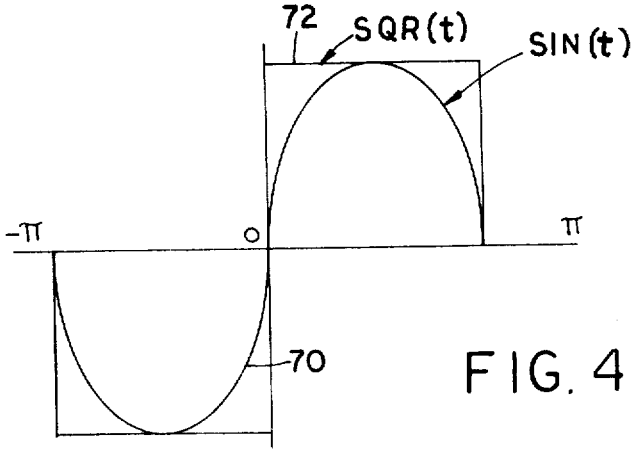
Figure 2:
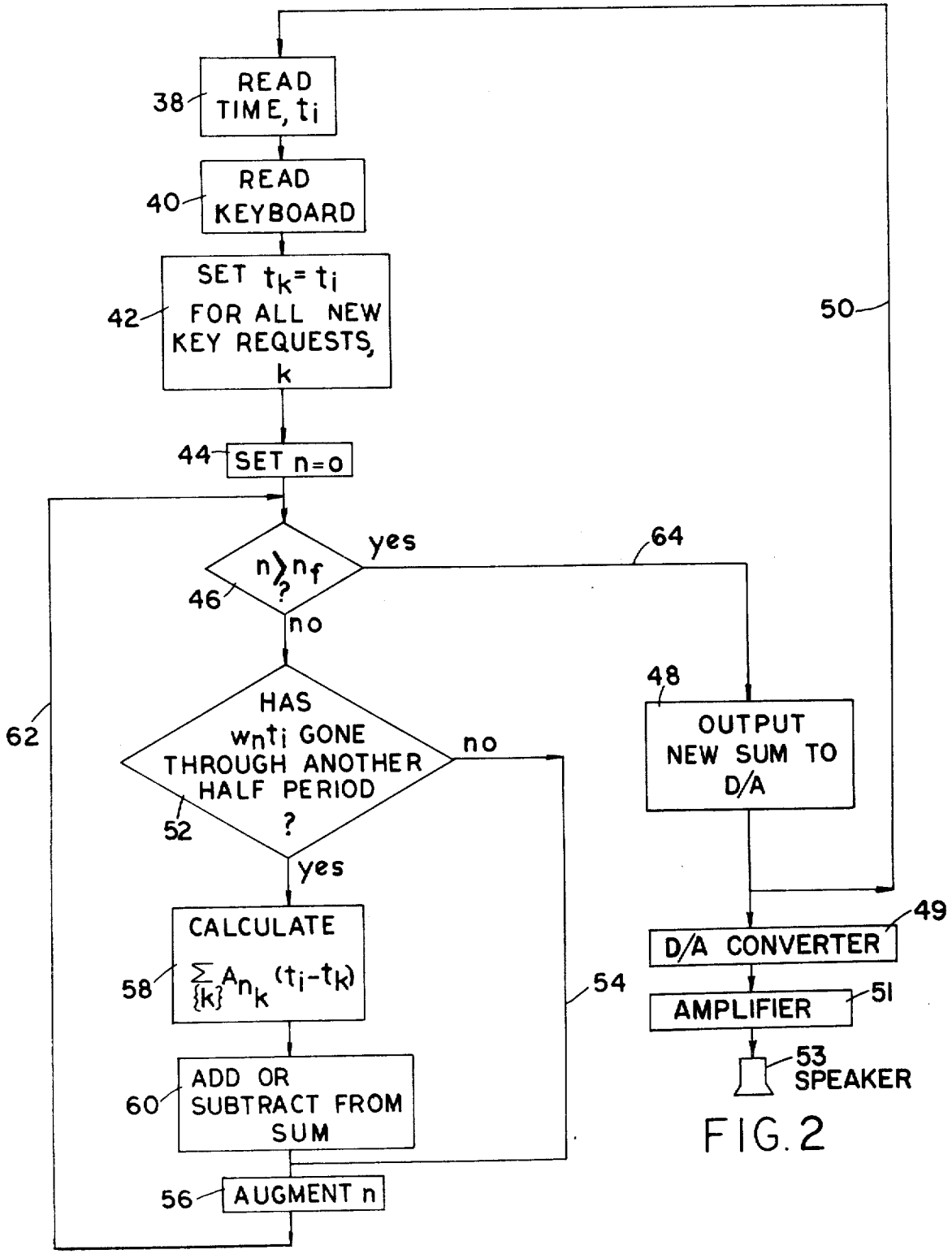

FIG. 10 discloses an embodiment of one type of analog key mechanism. A key 170 has affixed thereon an elongated permanent magnet 171 which is spring loaded by spring 172 and is adapted to slidably mount within a coil 173. The key 170 when depressed by an operator causes the permanent magnet 171 to move within coil 173, thereby generating a pulse of signal voltage having an amplitude proportional to the velocity of the movement of the permanent magnet. The signal voltage is coupled via a line 174 to a pulse stretcher circuit arrangement consisting of diode 175 and capacitor 176. The juncture of diode 175 and capacitor 176 is coupled via a line 178 to an analog multiplexer 179. One pulse stretcher is used for each key, not shown, for clarity. A field effect transistor (FET) 180 has its source and drain connected from line 178 to ground 181. The gate of FET 180 is coupled to decoder 182 via a line 183. Control signals from the control means 70 (FIG. 1) control which voltage is coupled to the analog to digital (A/D) converter 184, via a line 185, from the multiplexer 179. The output of A/D converter 184 is coupled to the data bus 74. The decoder 182 provides a signal to the gate of the FET 180 to insure the discharging of capacitor 176 at the proper time.

Figure 11:
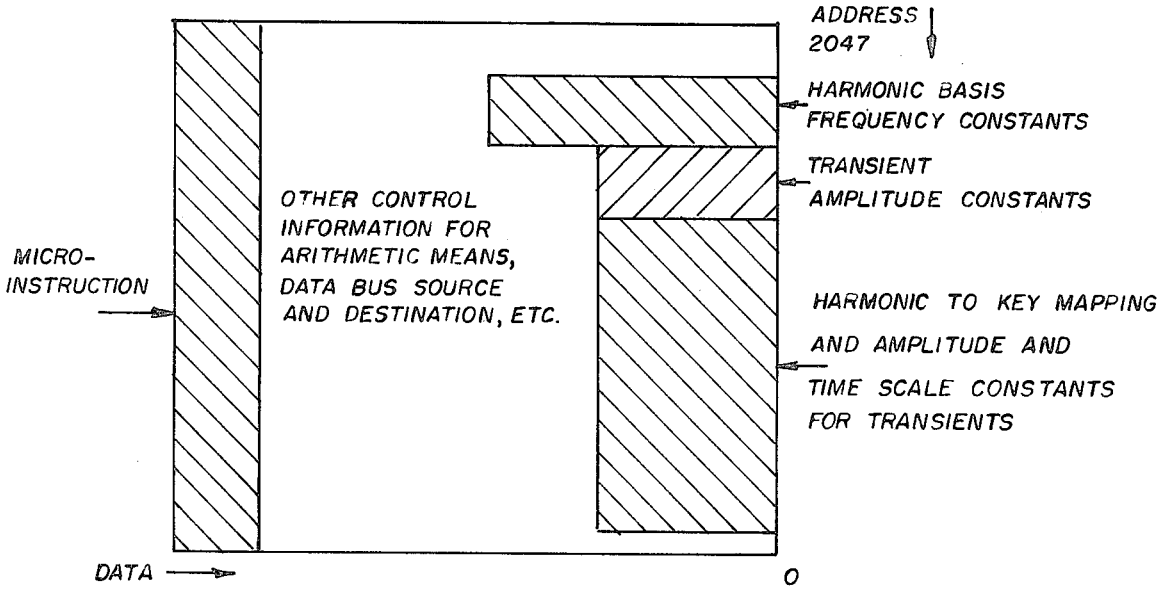
FIG. 11 is a graphical representation of some of the information stored in the control memory portion of the microcomputer in accordance with the present invention.

FIG. 11 discloses graphically the contents of the control memory 76 which contain, for example, the data for 256 control words for deriving the frequencies of the square wave harmonics and data representing the amplitude of a transient envelope as a function of time. The bulk of the remaining memory words contain information mapping which key contains a given harmonic together with the amplitude and time scaling factors to be applied to the transient. In addition, the memory contains additional control words that include instructions for performing sums, etc., shown in FIG. 2 and control information for the arithmetic means 72, data bus 74, etc. Each control word contains data representing the micro-instruction to be performed.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appended claims.

Having thus set forth the nature of the invention what is claimed is:

1. A musical synthesizer wherein musical waveshapes are synthesized comprising:

first memory means for storing a set of transient envelope waveshapes and a set of harmonic frequencies constituting said musical waveshapes;

means coupled to said first memory means for comparing and digitally approximating said musical waveshapes by the summing of square wave signals into digitalized waveform approximations of said musical waveshapes;

selecting means coupled to said first memory means a plurality of each of said selecting means controlling the initiation of one of said musical waveshapes; and means coupled to said selecting means and said first memory means for non-periodically computing said musical waveshapes dependent upon the state of any of said selecting means, said computing means including signal information derived from the state of said selecting means.

2. The musical synthesizer according to claim 1 wherein said non-periodically computing means comprises:

an oscillator coupled to a counter chain, said oscillator producing a driving signal for causing said counter chain to produce a digitalized timing signal representing the time, said timing signal having a greater periodicity than the periodicity of said oscillator;

a computing apparatus utilizing digitalized data processing techniques coupled to said counter chain for utilizing said digitalized timing signals;

a second memory means included in said computing apparatus, said set of transient envelope waveshapes and said set of harmonic frequencies stored within said first memory means, a portion of said first memory means controlling the operation of said computing apparatus, said computing apparatus selectively incorporating said digitalized timing signal and the state of said selecting means from said second memory in a continuous reviewing process to determine what terms need be synthesized.

3. The musical synthesizer according to claim 1 further including:

a digital to analog converter coupled to said computing means for receiving said digitalized waveform approximations and transforming it into an output signal having a complex wave shape;

an audio amplifier coupled to said digital to analog converter for amplifying said output signal;

a speaker coupled to said audio amplifier for changing said amplified output signal to an audio sound wave.

4. The musical synthesizer according to claim 1 wherein said means to digitally approximate said musical wave shapes includes a continuous reviewing means for causing a change in said digitalized waveform approximations when any of said set of harmonic frequencies change in periodicity in each computation period, said set of harmonic frequencies being expressed in said square wave form.

5. The musical synthesizer according to claim 1 wherein said keyboard comprises:

a plurality of manually operated switches.

6. The musical synthesizer according to claim 1 wherein said keyboard comprises;

a plurality of analog signal producing transducers including a permanent magnet disposed within a coil and a pulse stretcher network coupled thereto.

7. The musical synthesizer according to claim 1 wherein said each of said plurality of keys are manually independently operable.

8. The musical synthesizer in accordance with claim 1 wherein said non-periodically computing means comprises a closed loop, said closed loop repetitively monitoring said state of said selecting means maintaining thereby a memory of the recent history of said state of said selecting means up to date.

9. The musical synthesizer according to claim 1 wherein said musical waveshapes are computed in the real time domain.

10. The musical synthesizer according to claim 2 wherein said periodicity of said oscillator is unrelated to the periodicity of said set of transient envelope waveshapes and said set of harmonic frequencies.

11. The musical synthesizer according to claim 5 wherein said each computational period is lengthened by the number of any of said set of harmonic frequencies which have changed in half period in said each computational period.

* * * * *

UNITED STATES PATENT AND TRADEMARK OFFICE

CERTIFICATE OF CORRECTION

PATENT NO. : 4,177,706

DATED : December 11, 1979

INVENTOR(S) : Alan J. Greenberger

It is certified that error appears in the above—identified patent and that said Letters Patent is hereby corrected as shown below:

The Title page and Sheets 1 and 2 of the drawings should be deleted to appear as per attached.

Signed and Sealed this

*Sixth* Day of *May 1980*

[SEAL]

*Attest:*

SIDNEY A. DIAMOND

*Attesting Officer*

*Commissioner of Patents and Trademarks*

United States Patent [19]

Greenberger

[11] 4,177,706

[45] Dec. 11, 1979

[54] DIGITAL REAL TIME MUSIC SYNTHESIZER

[76] Inventor: Alan J. Greenberger, #8 Hart Ave., Hopewell, N.J. 08525

[21] Appl. No.: 922,803

[22] Filed: Jul. 7, 1978

Related U.S. Application Data

[63] Continuation-in-part of Ser. No. 721,447, Sep. 8, 1976, abandoned.

[51] Int. Cl.[2] ..... G10H 1/06; G10H 5/10

[52] U.S. Cl. ..... 84/1.01; 84/1.03; 364/718

[58] Field of Search ..... 84/1.01, 1.03, 1.24, 84/1.26, DIG. 7, DIG. 11; 364/718, 719, 721

[56] References Cited

U.S. PATENT DOCUMENTS

| | | | |
|---|---|---|---|
| 3,515,792 | 6/1970 | Deutsch | 84/1.01 |
| 3,743,755 | 7/1973 | Watson | 84/1.03 |
| 3,763,364 | 10/1973 | Deutsch | 84/1.03 |
| 3,809,786 | 5/1974 | Deutsch | 84/1.03 |
| 3,809,788 | 5/1974 | Deutsch | 84/1.03 |
| 3,809,789 | 5/1974 | Deutsch | 84/1.01 |
| 3,821,714 | 6/1974 | Tomisawa | 84/1.01 |
| 3,831,015 | 8/1974 | Hoff, Jr. | 84/1.01 |
| 3,836,909 | 9/1974 | Cockerell | 84/DIG. 7 |
| 3,878,749 | 4/1975 | Woron | 84/1.01 |
| 3,878,750 | 4/1975 | Kapps | 84/1.03 |
| 3,882,751 | 5/1975 | Tomisawa | 84/1.01 |
| 3,888,153 | 6/1975 | Deutsch | 84/1.03 |
| 3,910,150 | 10/1975 | Deutsch | 84/1.03 |
| 4,052,923 | 10/1977 | Cohn | 84/DIG. 7 |
| 4,077,294 | 3/1978 | Hiyoshi | 84/1.24 |

*Primary Examiner*—B. Dobeck
*Assistant Examiner*—William L. Feeney
*Attorney, Agent, or Firm*—Martin Sachs

[57] ABSTRACT

This disclosure pertains to a digitalized music synthesizer functioning in the real time domain to continuously update, in an asynchronous manner, a continuing approximation of a desired waveform by utilizing its memory of the recent history of the operation of the keyboard of the apparatus. A real time clock and a microcomputer are both driven by a single crystal oscillator, operating at any arbitrary frequency that need not correspond with the frequency of the fundamental or harmonic waves to be produced by the apparatus. A memory of the recent history of keyboard events is maintained. The microcomputer utilizes an algorithm employing square waves as a basis and a differential correcting technique which minimizes the quantity of square wave defining terms that need be computed by only recomputing at each time, corrections to the previous computation. The digitalized output, represented by summing the transient amplitudes comprising the updated approximation to the desired waveform, is fed into a digital to analog converter, an amplifier and a speaker system.

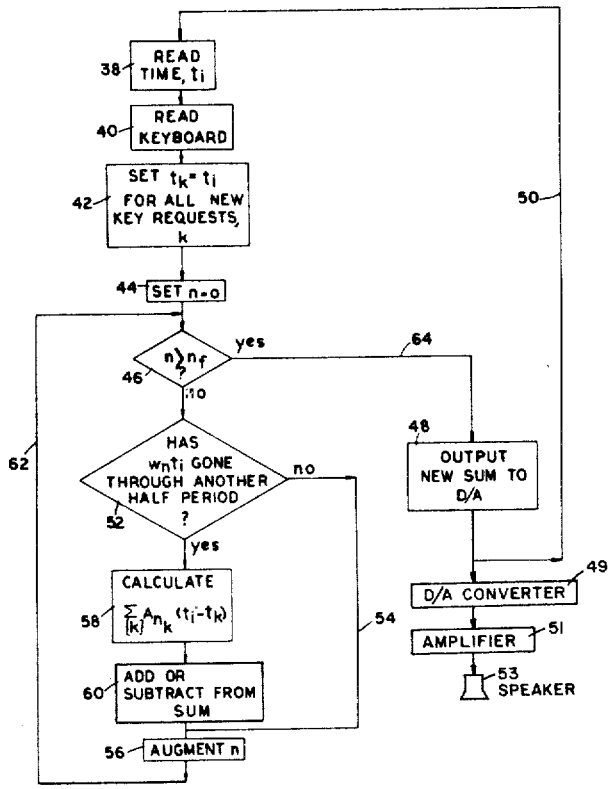

11 Claims, 11 Drawing Figures